US006540647B2

(12) United States Patent
Spooner et al.

(10) Patent No.: US 6,540,647 B2
(45) Date of Patent: Apr. 1, 2003

(54) WATER REHABILITATION DEVICE

(76) Inventors: Robert J. Spooner, 1117 11th Ave., Fargo, ND (US) 58103; Douglas A. Johnson, 3508 Longfellow Rd., Fargo, ND (US) 58102

( * ) Notice: Subject to any disclaimer, the term of this patent is extended or adjusted under 35 U.S.C. 154(b) by 37 days.

(21) Appl. No.: 09/812,335

(22) Filed: Mar. 19, 2001

(65) Prior Publication Data

US 2002/0132708 A1 Sep. 19, 2002

(51) Int. Cl.[7] ..... A63B 21/00
(52) U.S. Cl. ..... 482/55; 441/64
(58) Field of Search ..... 482/55; 441/55–64

(56) References Cited

U.S. PATENT DOCUMENTS

| | | | | | |
|---|---|---|---|---|---|
| 1,745,280 | A | | 1/1930 | Snapp | |
| 2,094,532 | A | | 9/1937 | Glad | |
| 3,084,355 | A | | 4/1963 | Ciccotelli | |
| 3,424,133 | A | | 1/1969 | Brady | |
| 3,427,022 | A | | 2/1969 | Ward | |
| 4,300,759 | A | | 11/1981 | Caplan | |
| 4,458,896 | A | | 7/1984 | Solloway | |
| 4,521,011 | A | * | 6/1985 | Solloway | 441/59 |
| 4,756,699 | A | | 7/1988 | Brom | |
| 4,813,668 | A | | 3/1989 | Solloway | |
| 4,973,049 | A | | 11/1990 | Ciolino | |
| 4,988,094 | A | | 1/1991 | Beasley | |
| 5,102,120 | A | | 4/1992 | Lindblad | |
| 5,338,275 | A | | 8/1994 | Chek | |
| 5,417,599 | A | * | 5/1995 | Evans | 441/64 |
| 5,702,331 | A | | 12/1997 | Perham | |

* cited by examiner

*Primary Examiner*—Glenn E. Richman
(74) *Attorney, Agent, or Firm*—Michael S. Neustel

(57) ABSTRACT

A water rehabilitation device for rehabilitating injuries and facilitating physical exercise. The water rehabilitation device includes a platform, a foot restraint attached to the platform, a first side wing pivotally attached to the platform, a second side wing pivotally attached to the platform opposite of the first side wing, a first end wing pivotally attached to the platform between the first side wing and the second side wing, and a second end wing opposite of the first end wing. During downward movement within water the wings are extended outwardly thereby creating an increased surface area effectively increasing the resistance to the downward movement. During upward movement within water the wings are folded downwardly providing an aerodynamic structure for providing reduced resistance to the upward movement.

20 Claims, 14 Drawing Sheets

WATER REHABILITATION DEVICE

BACKGROUND OF THE INVENTION

1. Field of the Invention

The present invention relates generally to rehabilitation devices and more specifically it relates to a water rehabilitation device for rehabilitating injuries and facilitating physical exercise.

2. Description of the Prior Art

Water rehabilitation devices have been in use for years. The most common type of water rehabilitation device is comprised of a buoyant structure that provides resistance during downward movement and assistance during upward movement within a body of water such as a pool.

Examples of patented rehabilitation devices which are illustrative of such prior art include U.S. Pat. No. 4,756,699 to Brom; U.S. Pat. No. 3,424,133 to Brady; U.S. Pat. No. 5,102,120 to Lindblad; U.S. Pat. No. 5,338,275 to Chek; U.S. Pat. No. 1,745,280 to Snapp; U.S. Pat. No. 2,094,532 to Glad; U.S. Pat. No. 3,084,355 to Ciccotelli; U.S. Pat. No. 4,988,094 to Beasley; U.S. Pat. No. 4,973,049 to Ciolino; U.S. Pat. No. 4,813,668 to Solloway; U.S. Pat. No. 4,458,896 to Solloway; U.S. Pat. No. 4,300,759 to Caplan; U.S. Pat. No. 3,427,022 to Ward; and U.S. Pat. No. 5,702,331 to Perham.

While these devices may be suitable for the particular purpose to which they address, they are not as suitable for rehabilitating injuries and facilitating physical exercise. Conventional rehabilitation devices are awkward to utilize and typically do not provide any resistance during an upward movement of the individual's leg.

In these respects, the water rehabilitation device according to the present invention substantially departs from the conventional concepts and designs of the prior art, and in so doing provides an apparatus primarily developed for the purpose of rehabilitating injuries and facilitating physical exercise.

SUMMARY OF THE INVENTION

In view of the foregoing disadvantages inherent in the known types of water rehabilitation devices now present in the prior art, the present invention provides a new water rehabilitation device construction wherein the same can be utilized for rehabilitating injuries and facilitating physical exercise.

The general purpose of the present invention, which will be described subsequently in greater detail, is to provide a new water rehabilitation device that has many of the advantages of the water rehabilitation devices mentioned heretofore and many novel features that result in a new water rehabilitation device which is not anticipated, rendered obvious, suggested, or even implied by any of the prior art water rehabilitation devices, either alone or in any combination thereof.

To attain this, the present invention generally comprises a platform, a foot restraint attached to the platform, a first side wing pivotally attached to the platform, a second side wing pivotally attached to the platform opposite of the first side wing, a first end wing pivotally attached to the platform between the first side wing and the second side wing, and a second end wing opposite of the first end wing. During downward movement within water the wings are extended outwardly thereby creating an increased surface area effectively increasing the resistance to the downward movement.

During upward movement within water the wings are folded downwardly providing an aerodynamic structure for providing reduced resistance to the upward movement.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a water rehabilitation device that will overcome the shortcomings of the prior art devices.

A second object is to provide a water rehabilitation device for rehabilitating injuries and facilitating physical exercise.

Another object is to provide a water rehabilitation device that is easy and simple to utilize.

An additional object is to provide a water rehabilitation device that is attachable to various sizes of feet.

A further object is to provide a water rehabilitation device that provides a substantial resistance during the downward movement of the leg and minimal resistance during an upward movement of the leg.

Another object is to provide a water rehabilitation device that allows an individual to maintain a relatively constant and steady position within the water thereby facilitating either a physical workout or rehabilitation.

An additional object is to provide a water rehabilitation device that has a non-impact resistance.

A further object is to provide a water rehabilitation device that reduces the user's body weight from an injured leg.

Another object is to provide a water rehabilitation device that is compact in structure and portable.

A further object is to provide a water rehabilitation device that provides the benefits of a stair-stepper machine and a stationary bike without the bodily impacts and forces.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
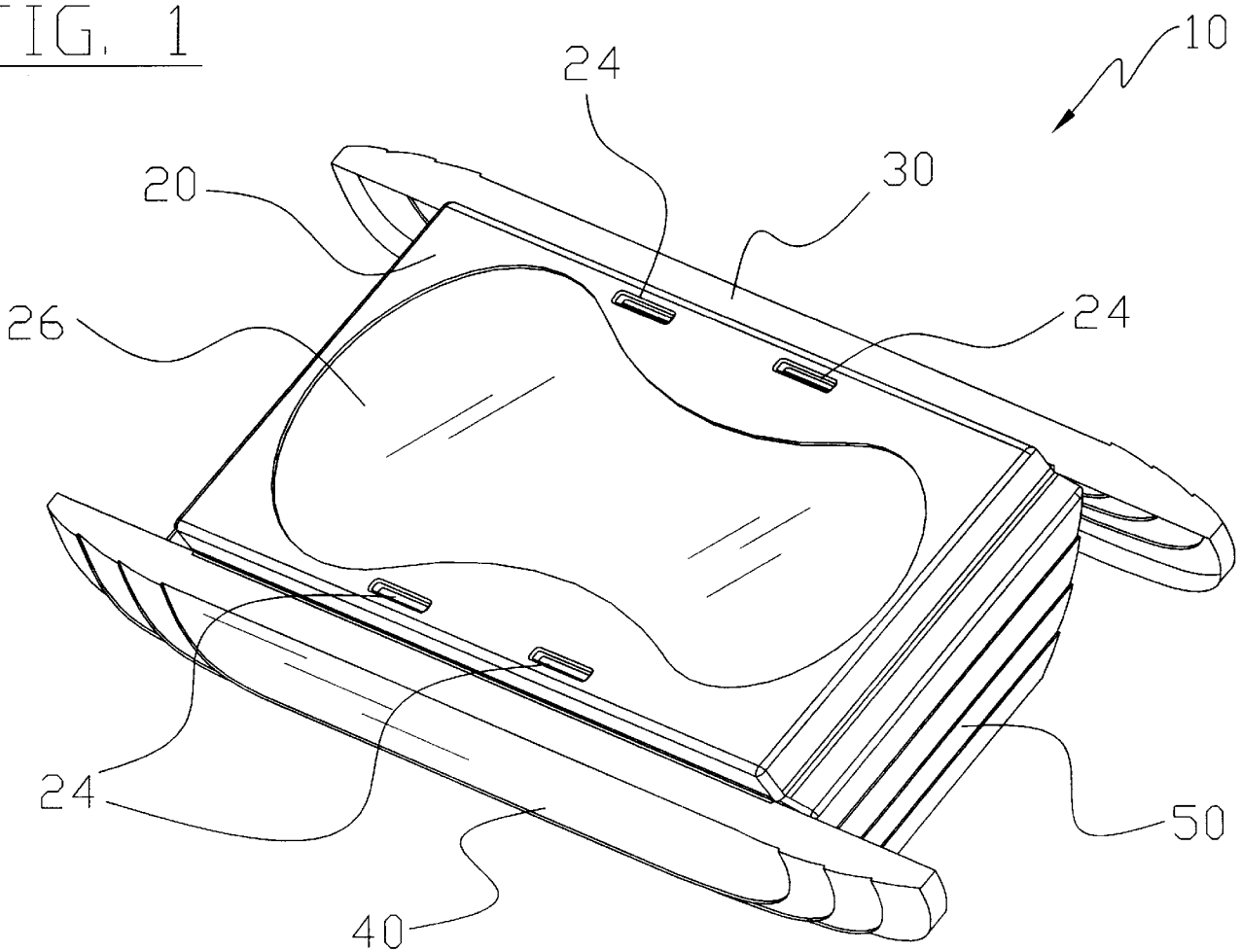
FIG. 1 is an upper perspective view of the present invention with the wings folded downwardly.
Figure 2:
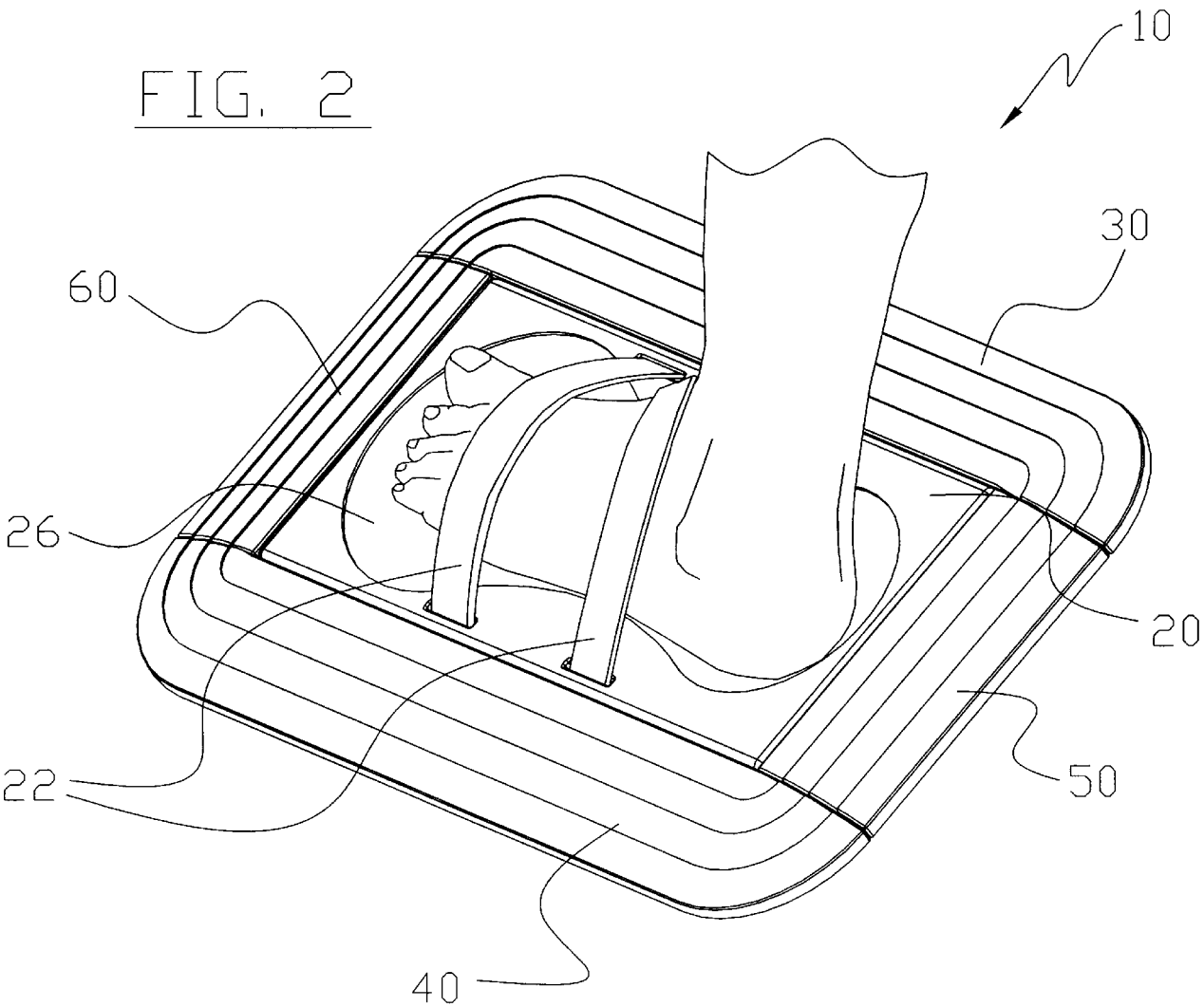
FIG. 2 is an upper perspective view of the present invention with the wings extended outwardly with a foot positioned with the foot restraint.
Figure 3:
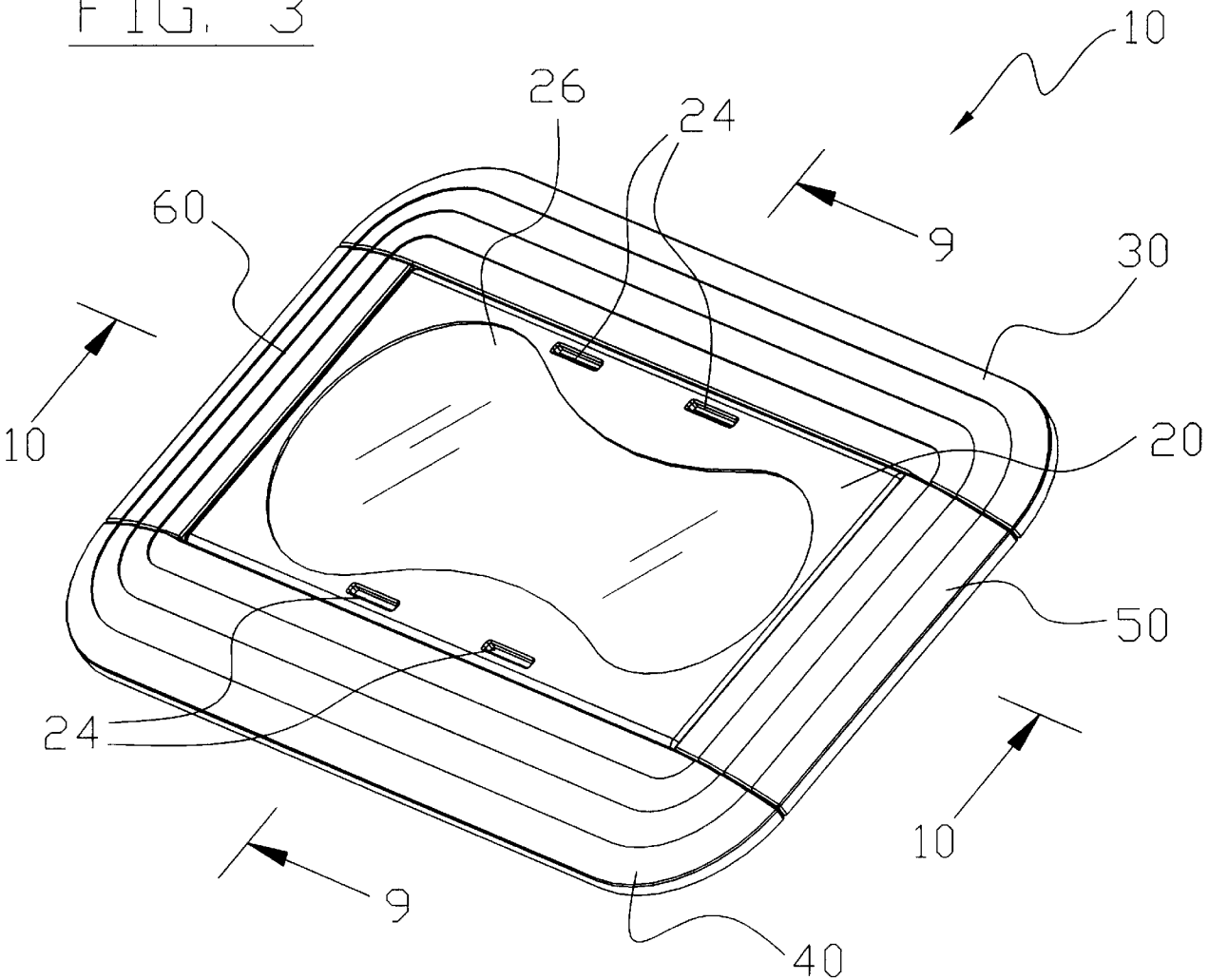
FIG. 3 is an upper perspective view of the present invention with the wings extended outwardly.

Turning now descriptively to the drawings, in which similar reference characters denote similar elements throughout the several views, FIGS. 1 through 14 illustrate a water rehabilitation device 10, which comprises a platform 20, a foot restraint 22 attached to the platform 20, a first side wing 30 pivotally attached to the platform 20, a second side wing 40 pivotally attached to the platform 20 opposite of the first side wing 30, a first end wing 50 pivotally attached to the platform 20 between the first side wing 30 and the second side wing 40, and a second end wing 60 opposite of the first end wing 50. During downward movement within water the wings are extended outwardly thereby creating an increased surface area effectively increasing the resistance to the downward movement. During upward movement within water the wings are folded downwardly providing an aerodynamic structure for providing reduced resistance to the upward movement.

As shown in FIGS. 1 through 6 of the drawings, the platform 20 is a generally broad structure. The platform 20 is preferably comprised of an elongated rectangular shape, however various other shapes may be utilized to construct the platform 20. The platform 20 may also include air pockets within for increasing the resistance during downward motion.

As shown in FIGS. 1 through 5 of the drawings, a depression 26 is preferably formed into an upper surface of the platform 20 for receiving the foot of a user. The platform 20 further includes a plurality of apertures 24 within the outer side portions thereof for receiving the foot restraint 22. The foot restraint 22 may be comprised of a plurality of straps or a plate member with locking members positionable within the apertures 24 of the platform 20. As can be appreciated, the foot restraint 22 may be comprised of various well-known restrain structures.

Figure 4:
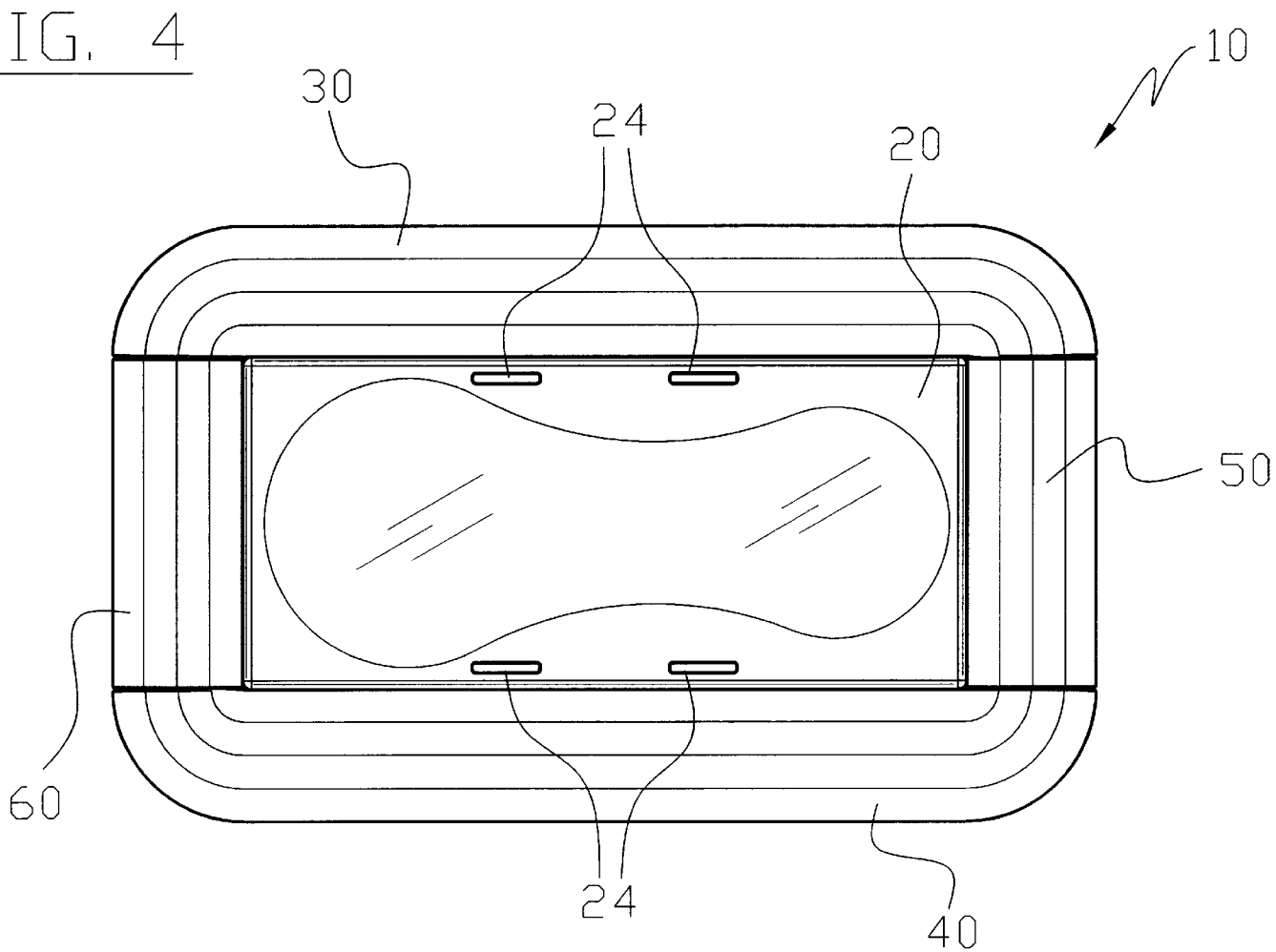
FIG. 4 is a top view of the present invention with the wings extended outwardly.
Figure 5:
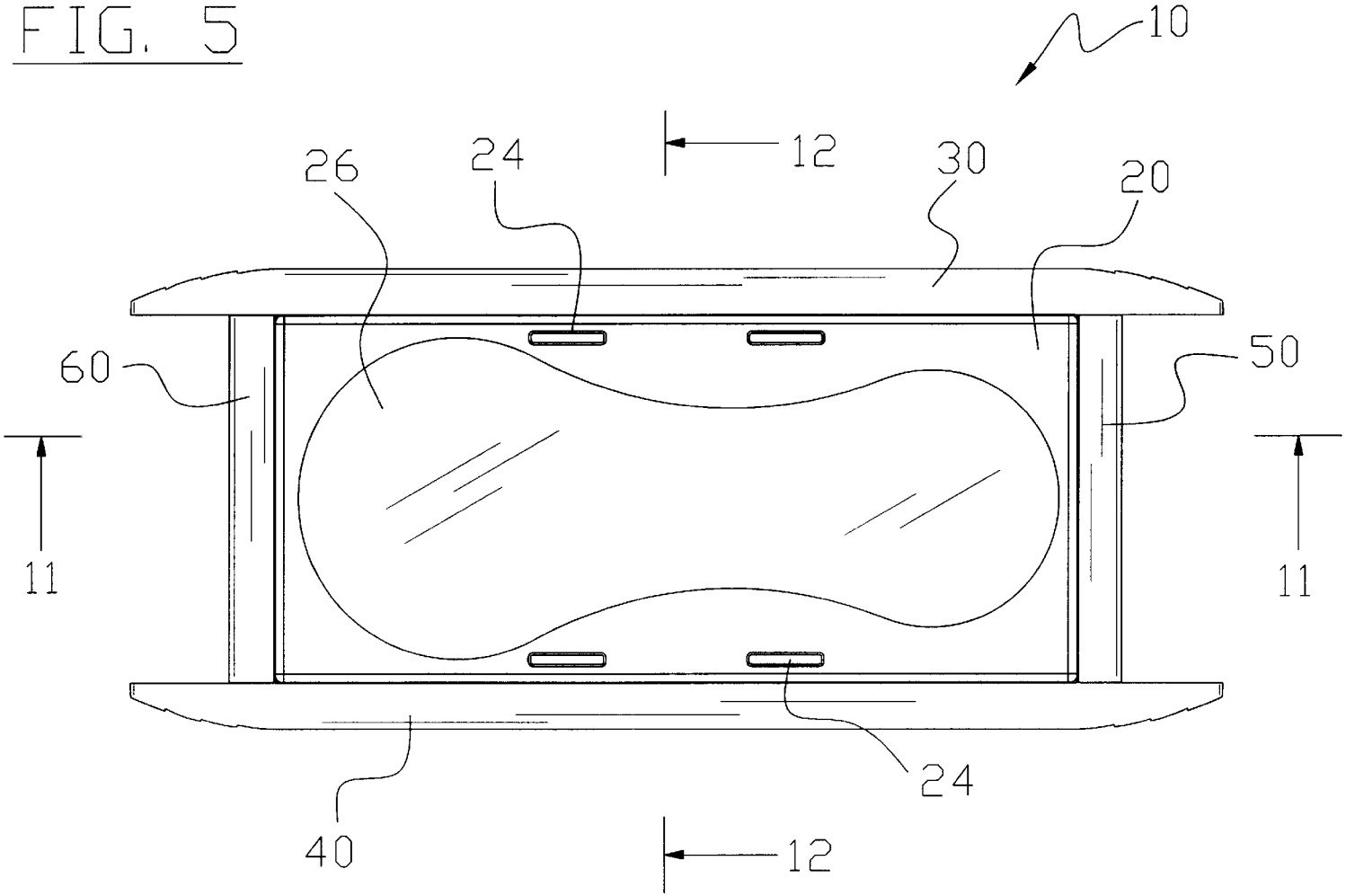
FIG. 5 is a top view of the present invention with the wings folded downwardly.
Figure 6:
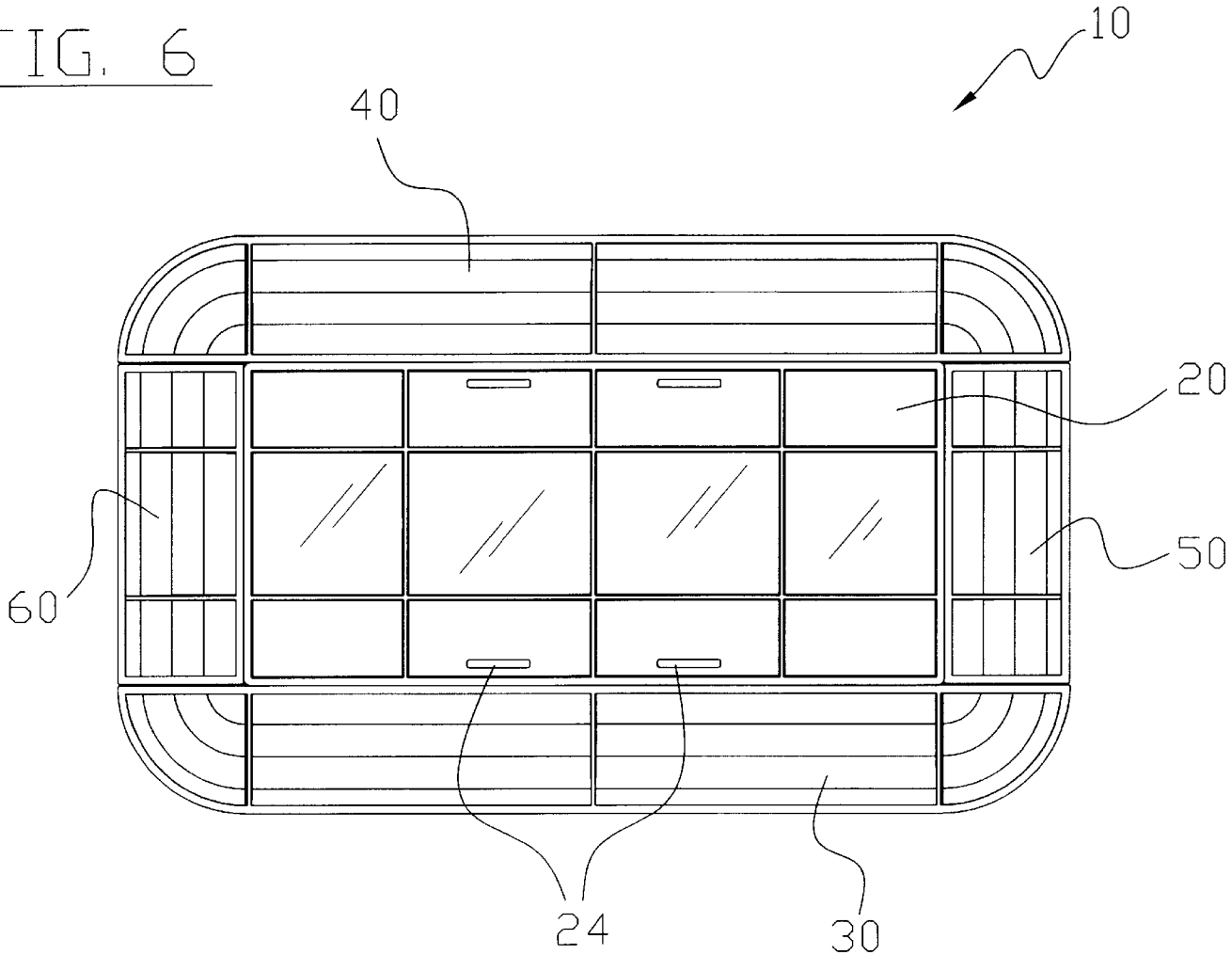
FIG. 6 is a bottom view of the present invention with the wings extended outwardly.

As shown in FIGS. 1 through 9 of the drawings, the first side wing 30 is pivotally attached to a side of the platform 20. The first side wing 30 preferably is longer in length than the length of the platform 20 as best illustrated in FIGS. 4 and 6 of the drawings. The first side wing 30 is preferably pivotally attached via a hinge or other structure commonly utilized to pivotally attach structures.

Figure 7:
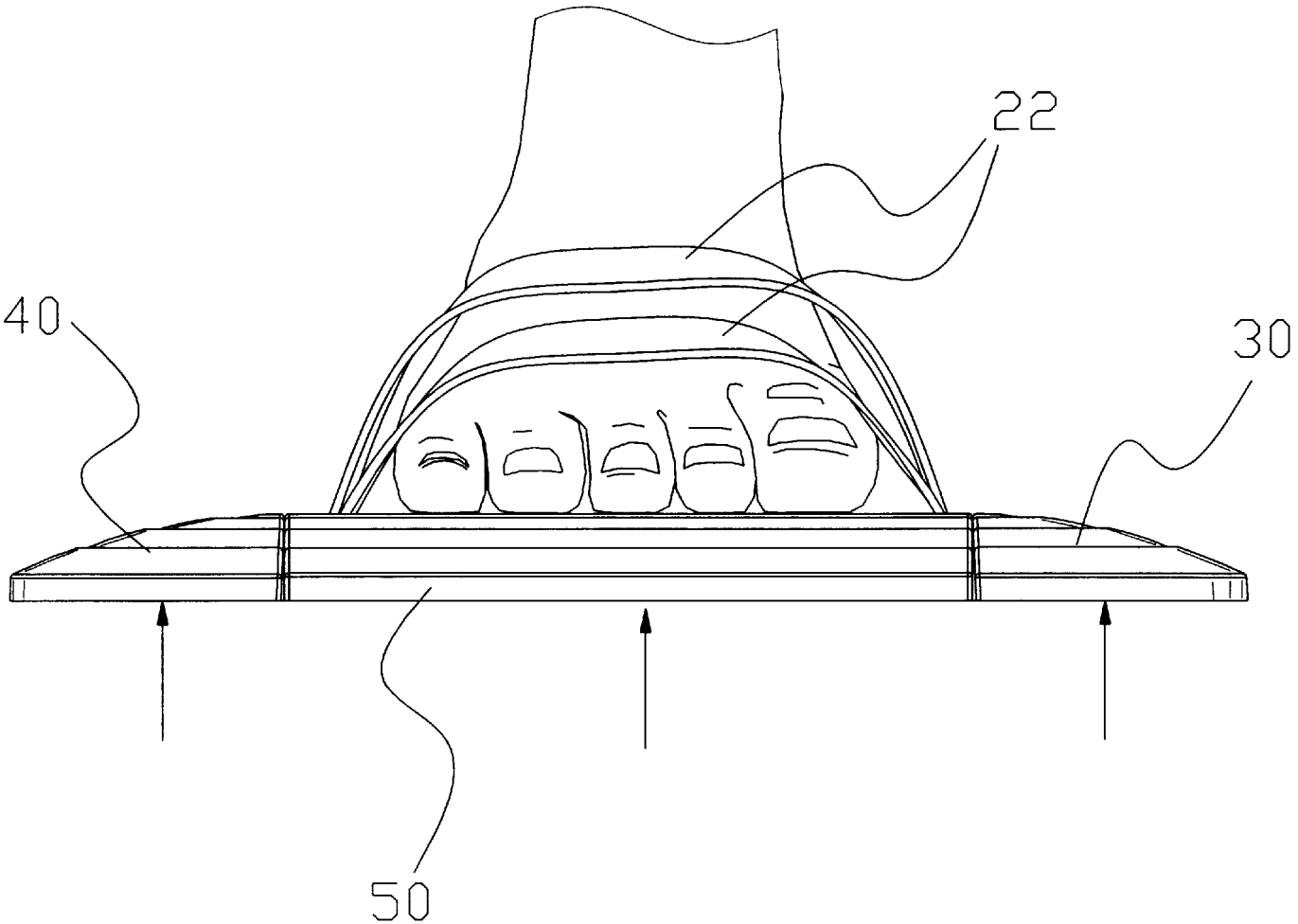
FIG. 7 is a front view of the present invention with the wings extended outwardly with a foot positioned within the foot restraint.
Figure 8:
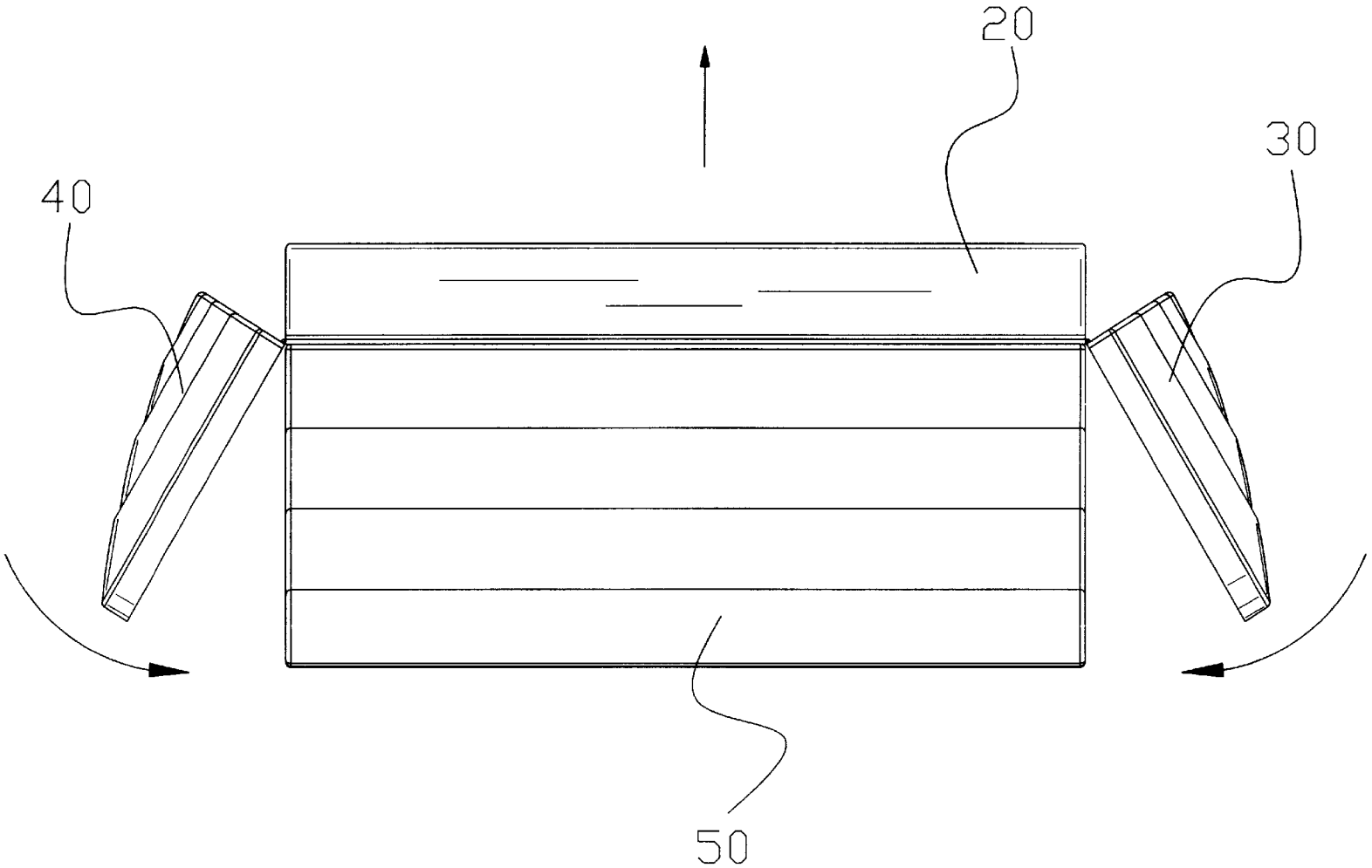
FIG. 8 is a front view of the present invention with the wings collapsing into the folded position.
Figure 9:
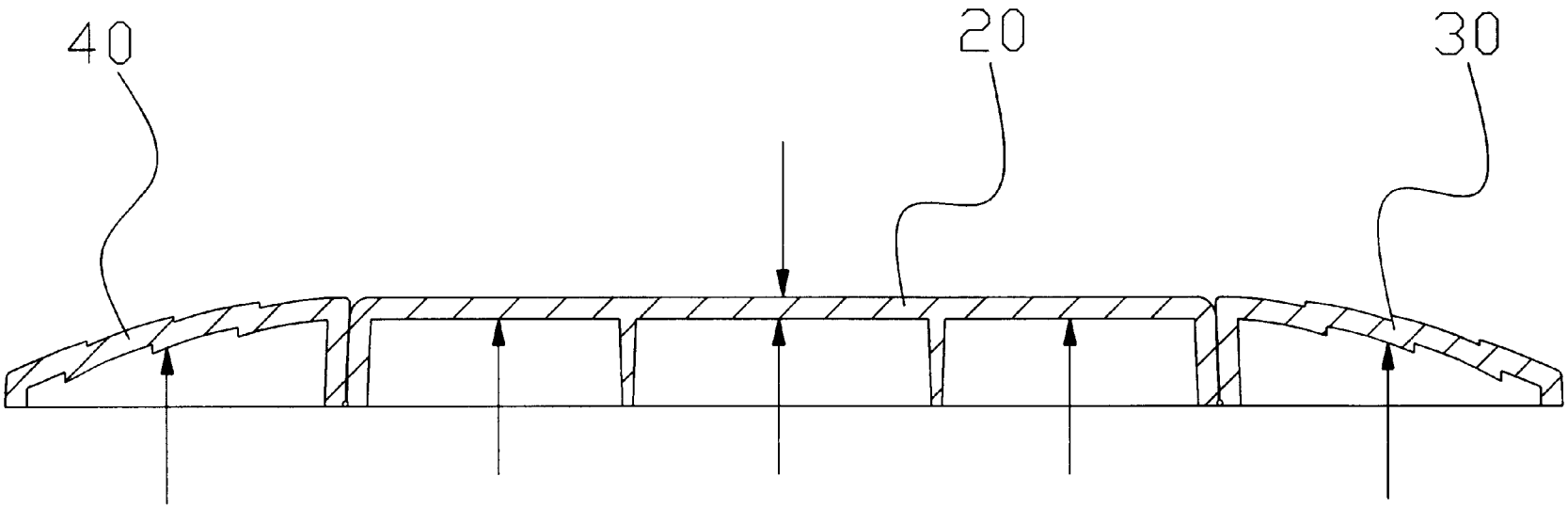
FIG. 9 is a cross sectional view taken along line 9—9 of FIG. 3.
Figure 12:
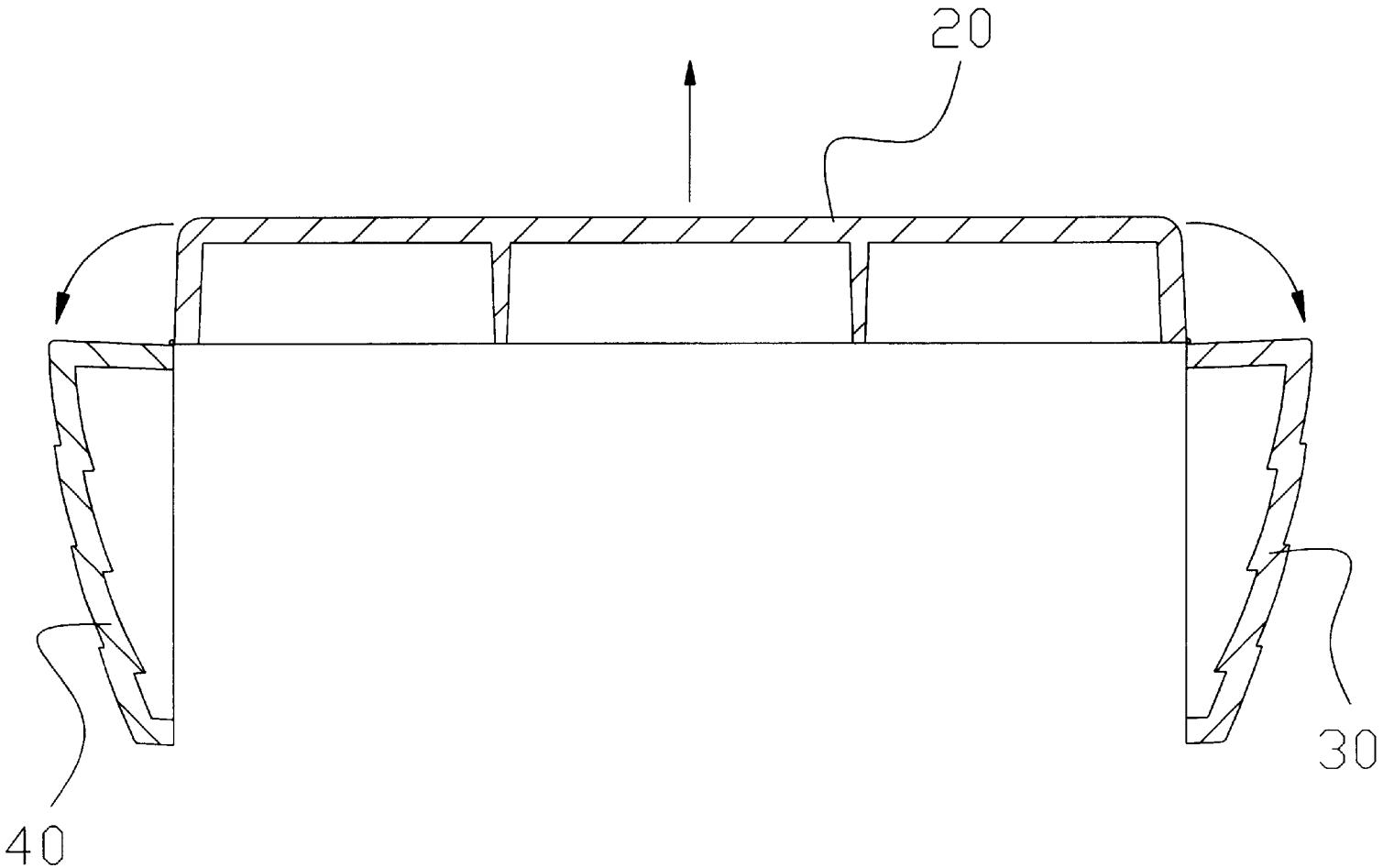
FIG. 12 is a cross sectional view taken along line 12—12 of FIG. 5.
Figure 13:
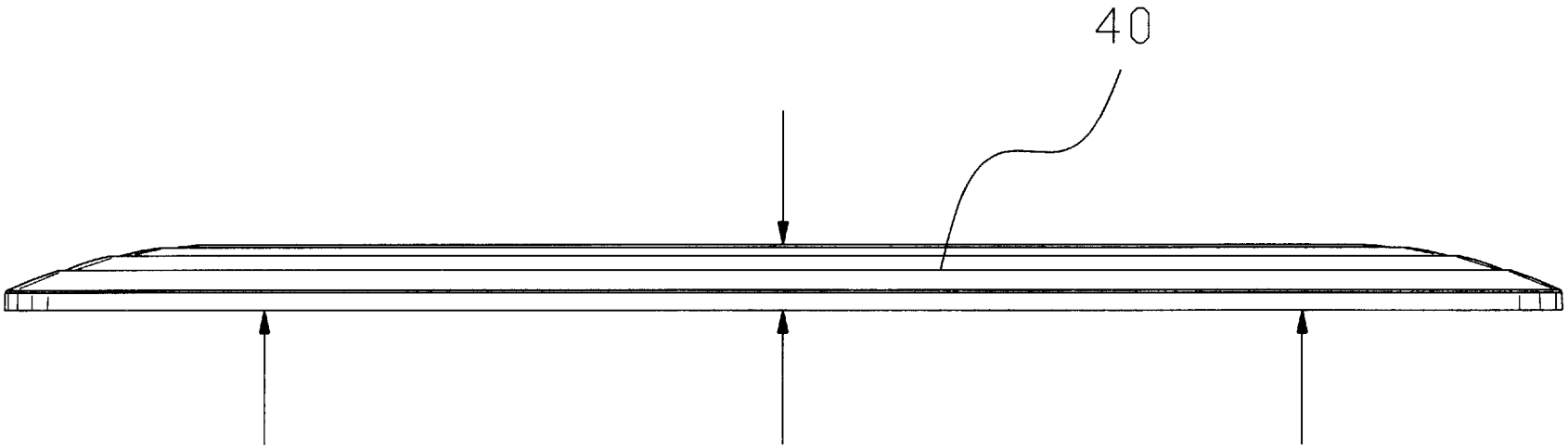
FIG. 13 is a side view of the present invention with the wings extended outwardly.
Figure 14:
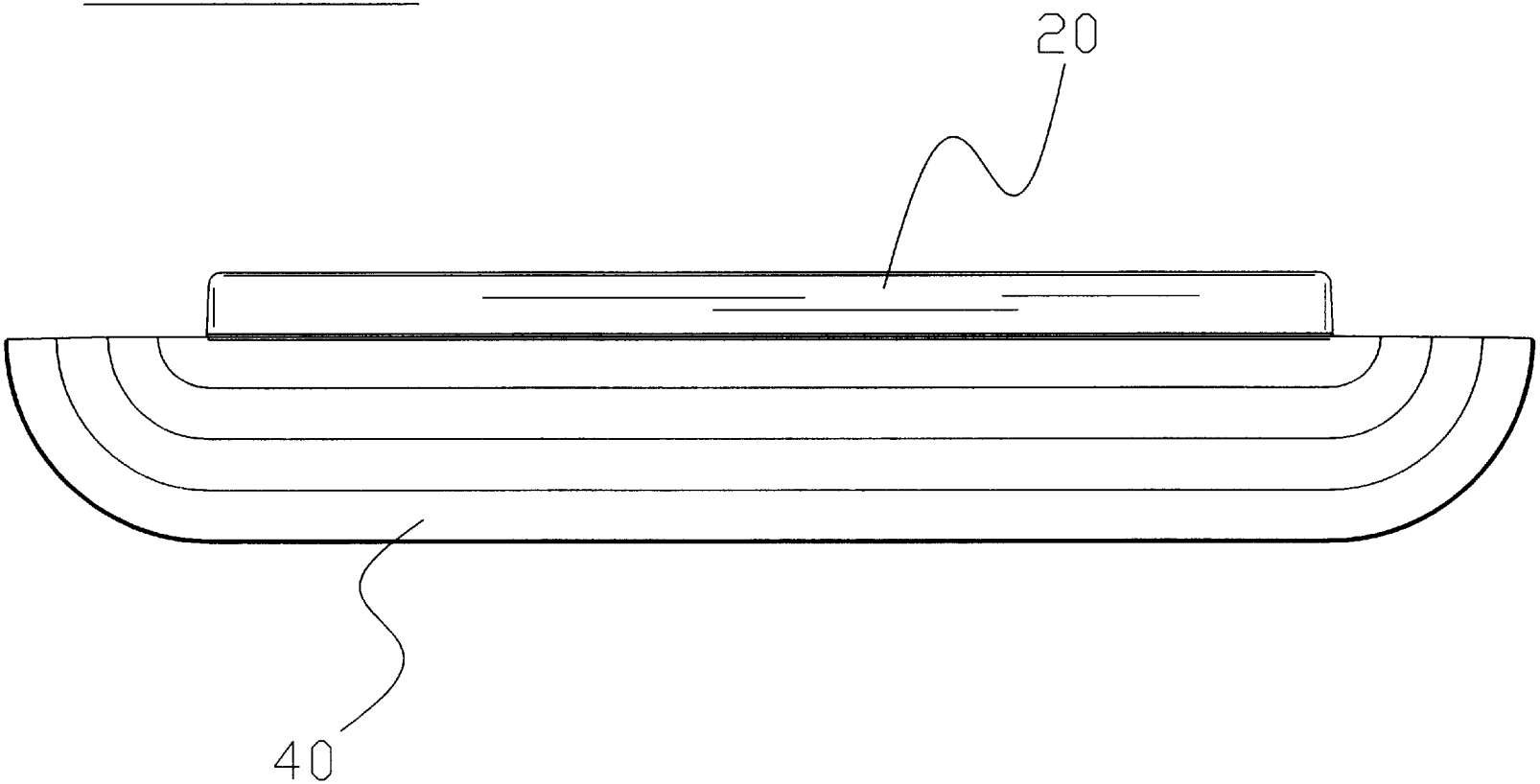
FIG. 14 is a side view of the present invention with the wings folded downwardly.

The upper edge adjacent to the platform 20 prevents the first side wing 30 from extending upward past a horizontal position as best illustrated in FIGS. 7 and 9 of the drawings. As shown in FIGS. 6 and 9 of the drawings, the first side wing 30 is preferably comprised of a cavity structure to "catch" the water during the downward motion thereof thereby causing the first side wing 30 to extend outwardly. The first side wing 30 is preferably tapered outwardly to reduce resistance during the upward motion of the present invention as best shown in FIGS. 6, 9 and 12 of the drawings.

As shown in FIGS. 1 through 9 of the drawings, the second side wing 40 is pivotally attached to a side of the platform 20 opposite of the first side wing 30. The second side wing 40 preferably is longer in length than the length of the platform 20 as best illustrated in FIGS. 4 and 6 of the drawings. The second side wing 40 is preferably similar in size and shape to the first side wing 30 to "balance" the platform 20 during usage within water by the user. The second side wing 40 is preferably pivotally attached via a hinge or other structure commonly utilized to pivotally attach structures.

The upper edge adjacent to the platform 20 prevents the second side wing 40 from extending upward past a horizontal position as best illustrated in FIGS. 7 and 9 of the drawings. As shown in FIGS. 6 and 9 of the drawings, the second side wing 40 is preferably comprised of a cavity structure to "catch" the water during the downward motion thereof thereby causing the second side wing 40 to extend outwardly. The second side wing 40 is preferably tapered outwardly to reduce resistance during the upward motion of the present invention as best shown in FIGS. 6, 9 and 12 of the drawings.

As shown in FIGS. 1 through 6, 10 and 11 of the drawings, the first end wing 50 is pivotally attached to an end of the platform 20 between the first side wing 30 and the second side wing 40. The first end wing 50 preferably has a length similar to the width of the platform 20 as best illustrated in FIGS. 4 and 6 of the drawings. The first end wing 50 is preferably pivotally attached via a hinge or other structure commonly utilized to pivotally attach structures.

Figure 10:
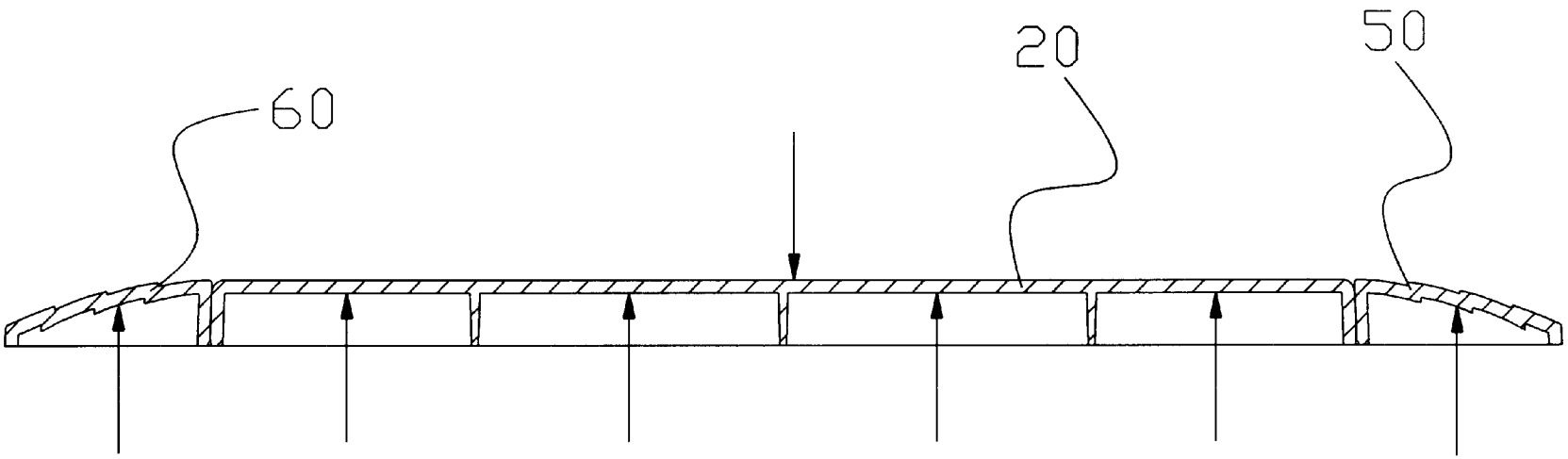
FIG. 10 is a cross sectional view taken along line 10—10 of FIG. 3.
Figure 11:
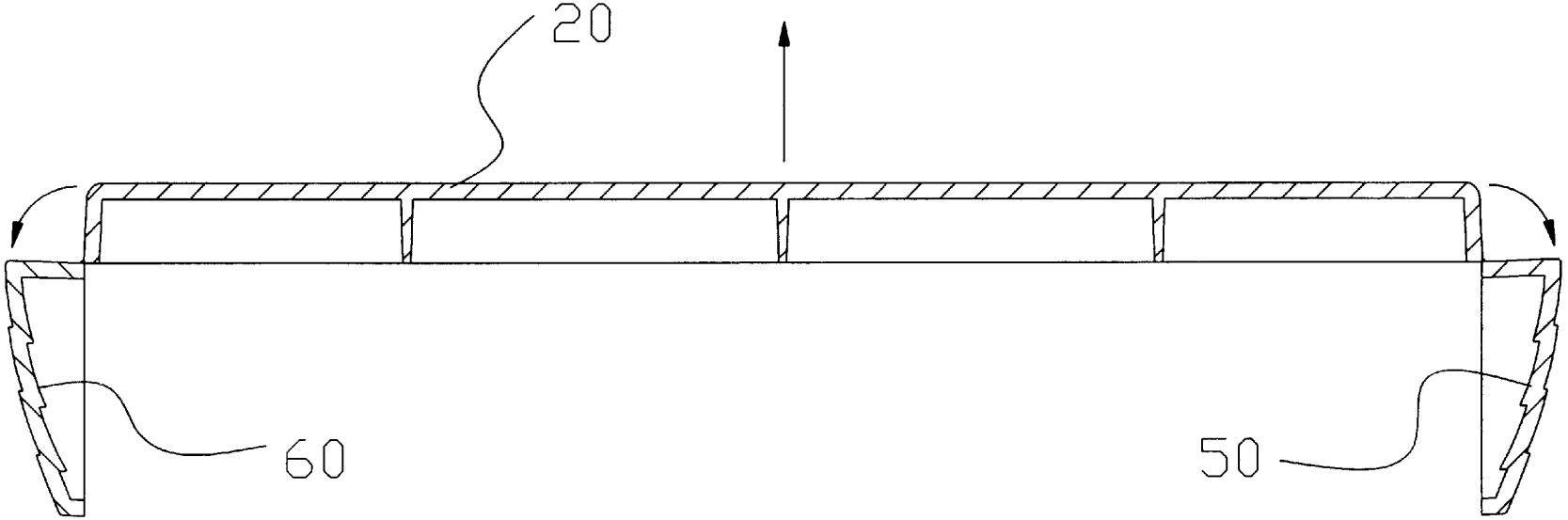
FIG. 11 is a cross sectional view taken along line 11—11 of FIG. 5.

The upper edge adjacent to the platform 20 prevents the first end wing 50 from extending upward past a horizontal position as best illustrated in FIGS. 10 and 11 of the drawings. As shown in FIGS. 10 and 11 of the drawings, the first end wing 50 is preferably comprised of a cavity structure to "catch" the water during the downward motion thereof thereby causing the first end wing 50 to extend outwardly. The first end wing 50 is preferably tapered outwardly to reduce resistance during the upward motion of the present invention as best shown in FIGS. 6, 9 and 12 of the drawings.

As shown in FIGS. 1 through 6, 10 and 11 of the drawings, the second end wing 60 is pivotally attached to an end of the platform 20 between the first side wing 30 and the second side wing 40 opposite of the first end wing 50. The second end wing 60 preferably has a length similar to the width of the platform 20 as best illustrated in FIGS. 4 and 6 of the drawings. The second end wing 60 is preferably similar in size and shape to the first end wing 50 to "balance" the platform 20 during usage within water by the user. The second end wing 60 is preferably pivotally attached via a hinge or other structure commonly utilized to pivotally attach structures.

The upper edge adjacent to the platform 20 prevents the second end wing 60 from extending upward past a horizontal position as best illustrated in FIGS. 10 and 11 of the drawings. As shown in FIGS. 10 and 11 of the drawings, the second end wing 60 is preferably comprised of a cavity structure to "catch" the water during the downward motion thereof thereby causing the second end wing 60 to extend outwardly. The second end wing 60 is preferably tapered outwardly to reduce resistance during the upward motion of the present invention as best shown in FIGS. 6, 9 and 12 of the drawings.

In use, the user positions their foot within the foot restraint 22 attached to the platform 20 preferably while positioned within the water or adjacent to the water. The user then enters a depth of water sufficient for them to provide upward and downward movement of their legs within the wings 30, 40, 50, 60 engaging the pool floor. The user then is able to move their leg upwardly and downwardly. During upward movements of the leg the wings 30, 40, 50, 60 are folded inwardly and downwardly to provide an aerodynamic structure thereby providing reduced resistance during the upward motion of the leg as shown in FIGS. 11 and 12 of the drawings. When the user begins the downward motion of their respective leg, the wings 30, 40, 50, 60 "catch" the water along with the platform 20 thereby causing the wings 30, 40, 50, 60 to pivotally extend outwardly until substantially parallel to the platform 20 as shown in FIGS. 7, 9, 10 and 13 of the drawings. With the wings 30, 40, 50, 60 extended outwardly parallel to the platform 20, the total combined surface area of the platform 20 and wings 30, 40, 50, 60 provides increased resistance during the downward motion. The user then brings their foot upwardly thereby repeating the entire process.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A water rehabilitation device for providing increased resistance during downward motion and decreased resistance during upward motion thereof, comprising:

a platform;

a foot restraint attached to said platform;

a first side wing pivotally attached to a side of said platform;

a second side wing pivotally attached to a side of said platform opposite of said first side wing;

a first end wing pivotally attached to an end of said platform; and a second end wing pivotally attached to an end of said platform opposite of said first end wing.

2. The water rehabilitation device of claim 1, wherein said wings are positionable in a folded position during an upward motion and wherein said wings are positionable in an extended position during a downward motion.

3. The water rehabilitation device of claim 2, wherein said wings are substantially parallel to said platform when positioned in said extended position.

4. The water rehabilitation device of claim 1, wherein said first side wing is substantially similar in shape and size to said second side wing.

5. The water rehabilitation device of claim 1, wherein said first end wing is substantially similar in shape and size to said second end wing.

6. The water rehabilitation device of claim 1, wherein said wings are tapered.

7. The water rehabilitation device of claim 1, wherein said wings are comprised of a cavity structure.

8. The water rehabilitation device of claim 1, wherein said first side wing and said second side wing extend past opposing ends of said platform.

9. The water rehabilitation device of claim 2, wherein said first side wing and said second side wing extend to an outer edge of said first end wing and said second end wing when in an extended position.

10. The water rehabilitation device of claim 1, wherein said platform includes a depression within an upper surface thereof for receiving a foot.

11. A water rehabilitation device for providing increased resistance during downward motion and decreased resistance during upward motion thereof, comprising:

a platform having a plurality of apertures;

a foot restraint having a plurality of catch members positionable within said plurality of apertures;

a first side wing pivotally attached to a side of said platform;

a second side wing pivotally attached to a side of said platform opposite of said first side wing;

a first end wing pivotally attached to an end of said platform; and a second end wing pivotally attached to an end of said platform opposite of said first end wing.

12. The water rehabilitation device of claim 11, wherein said wings are positionable in a folded position during an upward motion and wherein said wings are positionable in an extended position during a downward motion.

13. The water rehabilitation device of claim 12, wherein said wings are substantially parallel to said platform when positioned in said extended position.

14. The water rehabilitation device of claim 11, wherein said first side wing is substantially similar in shape and size to said second side wing.

15. The water rehabilitation device of claim 11, wherein said first end wing is substantially similar in shape and size to said second end wing.

16. The water rehabilitation device of claim 11, wherein said wings are tapered.

17. The water rehabilitation device of claim 11, wherein said wings are comprised of a cavity structure.

18. The water rehabilitation device of claim 11, wherein said first side wing and said second side wing extend past opposing ends of said platform.

19. The water rehabilitation device of claim 12, wherein said first side wing and said second side wing extend to an outer edge of said first end wing and said second end wing when in said extended position.

20. The water rehabilitation device of claim 11, wherein said foot restraint includes a plate member supporting said plurality of catch members.

* * * * *